United States Patent [19]

Lesgourgues

[11] 4,246,218

[45] Jan. 20, 1981

[54] PROCESS FOR THE MANUFACTURE OF A PIECE COMPRISING AT LEAST ONE POROUS ABRADABLE MATERIAL

[75] Inventor: Jacques Lesgourgues, Corbeil, France

[73] Assignee: Societe Nationale d'Etude et de Construction de Moteurs d'Aviation, Paris, France

[21] Appl. No.: 59,751

[22] Filed: Jul. 23, 1979

[30] Foreign Application Priority Data

Jul. 25, 1978 [FR] France ..... 78 21895

[51] Int. Cl.[3] ..... B22F 3/16

[52] U.S. Cl. ..... 264/111; 264/118; 264/263; 264/271; 264/275; 428/550; 428/554; 428/555

[58] Field of Search ..... 51/293, 296, 307, 309, 51/308; 264/275, 263, 261, 279, 271, 111, 118; 428/545, 551, 550, 547, 544, 554, 555

[56] References Cited

U.S. PATENT DOCUMENTS

| | | | |
|---|---|---|---|
| 3,369,879 | 2/1968 | Miller | 51/293 |
| 3,664,819 | 5/1972 | Sioui et al. | 51/298 |
| 3,756,796 | 9/1973 | Miller | 51/309 |
| 3,829,299 | 8/1974 | Metzger | 51/309 |
| 4,024,675 | 5/1977 | Naidich et al. | 51/296 |

FOREIGN PATENT DOCUMENTS

| | | |
|---|---|---|
| 949279 | 7/1947 | France . |
| 611818 | 11/1948 | United Kingdom . |
| 1412415 | 11/1975 | United Kingdom . |

*Primary Examiner*—Donald J. Arnold
*Attorney, Agent, or Firm*—Bacon & Thomas

[57] ABSTRACT

The invention concerns a process for the manufacture of pieces comprising at least one part of an abradable, porous material, which may be integral with a support part. The process is characterized in that synthesis by diffusion of the abradable material is effected in a mold, at least one part of which constitutes the support piece.

3 Claims, 2 Drawing Figures

PROCESS FOR THE MANUFACTURE OF A PIECE COMPRISING AT LEAST ONE POROUS ABRADABLE MATERIAL

BACKGROUND OF THE INVENTION

The present invention concerns formed pieces comprising at least one portion of a porous abradable material and the process for the preparation of said pieces.

It is known that abradables are materials subject to wear by abrasion, they are used in particular as linings in turbine housings to limit the clearance at the tip of the blades. Such abradable materials employed at elevated temperatures, are frequently porous materials wherein a metallic piece may cut an impression due to the shifting of said piece and to the friction of the piece against these materials. Such porous materials are available in the form of plates, which most frequently are shaped and mounted on a support. This shaping and mounting process poses difficult industrial problems. Furthermore, it is often desirable, for cooling purposes, to place internal partitions in these materials, which are difficult to apply with conventional materials.

SUMMARY OF THE INVENTION

The present invention concerns a process for the preparation of shaped pieces at least portions of which are of an abradable material. Said pieces may consists solely of the abradable material or they may comprise, as a support and/or as an internal partition, a part joined by brazing to said material and consisting of a metal or an alloy.

The process according to the invention is characterized by a mold being used wherein the synthesis of the abradable material is effected by diffusion. Synthesis by diffusion may be effected advantageously by the process described in the application Ser. No. 58,487 filed July 18, 1979 by the present applicant for a "novel porous body and process for its preparation". According to this process, said mold is filled with a mixture of powders, one of which represents 85 to 99.5% by weight of the mixture and is a base material selected from the group consisting of nickel, cobalt, iron and various alloys of these metals, and a fusible and diffusible material chosen from tin, indium, gallium, germanium, antimony, together with the mixtures and alloys of said metals and the mold is subsequently heated in a controlled atmosphere, at a temperature and for the period of time sufficient to cause a bond to be formed between the powder particles of the base metals by means of diffusion brazing.

Thus, according to the invention, the abradable material is prepared in a mold having a shape corresponding to the shape of the final piece desired; because the abradable material is synthesized in a mold by means of the diffusion of the particles of the base material, it is conceivable that depending on the material constituting the mold, said mold itself may be bonded by its entire internal surface of by a part of said internal surface, to the abradable material being synthesized and that it thus may constitute, in its entirety or in part, a portion of the final piece to carry the abradable material; it is equally conceivable that inside the mold and prior to the introduction of the powders, various metal partitions may be conveniently introduced and positioned, said partitions being locked in and bonded to the abradable material synthetized in the mold.

The materials used to prepare the abradable materials are in the form of powders with grain sizes of between 80 and 220 microns. Diffusion takes place in a controlled atmosphere, i.e., in an inert gas atmosphere or in a vacuum. The powder mixture is not subjected to an external pressure, other than a possible pressure of the inert gas, during heating.

In the case when an auxiliary powder of a fusible material is used, diffusion brazing is obtained by heating to a temperature higher than the melting temperature of the fusible material but lower than the solidus of the base material. The duration of heating is considered sufficient when, for a given temperature, the entirety of the fusible material has diffused within the base material.

In one mode of embodiment of the invention, the shaped piece consists solely of the abradable material. In such a case a mold, for example, one that may be dismantled, having walls prepared so that the powders do not adhere to said walls during the process of the preparation of the abradable material. The mold may have, for example, walls lined with alumina or with a known antiwetting agent.

In another mode of embodiment of the invention, the finished piece comprises a part of an abradable material synthesized in situ and a part consisting of a mold or a part of the mold and/or at least one metal partition located at least in part within the abradable material. In this case, the fusible material present in the powder mixture will perform not only the function of diffusion brazing the base material in the form of a powder, but also functions to diffusion braze said base material to the mold and/or the partition. The conditions under which the process according to the invention is effected will have to take into account this new role of the fusible material in relation to the mold and/or the partition. The non-limiting examples following hereinbelow will serve to illustrate the invention.

EXAMPLE 1

A mixutre is prepared of 95% by weight of a powder of an 80/20 nickel-chromium alloy (grain size: 80 to 140 microns) with 5% by weight of a powder of tin with an average grain size or approximately 150 microns; after homogenization, the mixture is poured in the cavity of a mold consisting of a bottom support of KC20WN, the upper surface whereof is lined with alumina upon which four blocks of KC20WN are conveniently placed, said blocks also having the facing surfaces lined with alumina. The material referred to above as KC20WN is a cobalt based alloy containing about 20% of chromium, 15% tungsten, 10% nickel and about 0.4% of silicon. The material is also sold in the United States by the CABOT Company, under the designation HS25. The assembly is placed in a furnace wherein a vacuum of $10^{-3}$ Pa is maintained and then heated at 1125° C. for 15 minutes. After cooling, the mold is dismantled and a specimen of an abradable material with a density of approximately 3.2 obtained.

EXAMPLE 2

Porous abradable material bonded to a metallic support with partition

This example will be described with reference to the schematic drawings attached hereto wherein.

Figure 1:
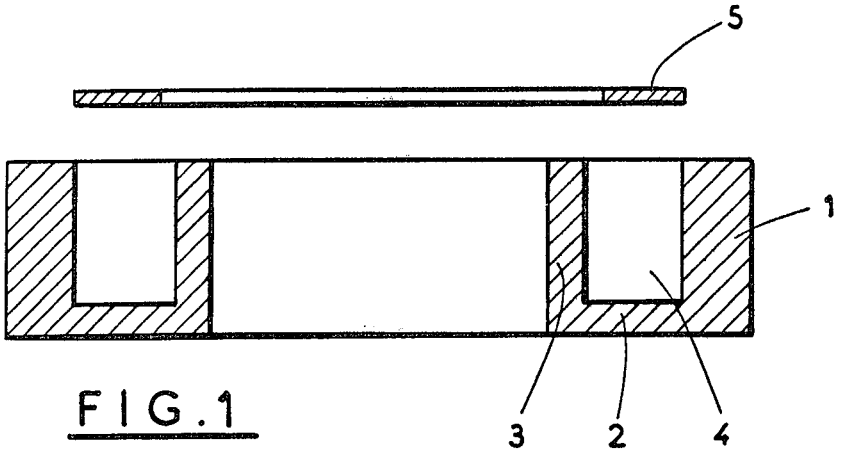
FIG. 1 is a sectional view of a mold and a partition.

A mold having the form shown in a transverse section in FIG. 1, is prepared. The metallic support to which the porous abradable material is to be mounted, consists of a ferrule 1. The mold is further bounded by a bottom 2 and an internal ferrule 3.

Figure 2:
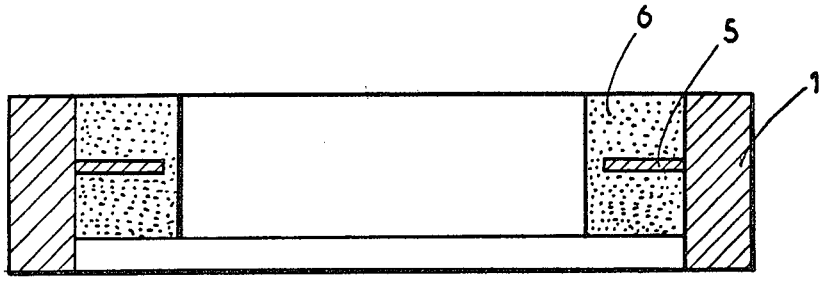
FIG. 2 is a sectional view of the mold of FIG. 1 at a later stage of the process.

A homogeneous mixture of 95% by weight of a powder of an 80/20 nickel-chromium alloy with an average grain size of 80–140 microns, with 5% by weight of a powder of tin with an average grain size of approximately 150 microns, is prepared. A portion of said mixture is introduced in the cavity 4 of the mold (the cavity having the form of a torus with a rectangular section). When the cavity 4 is filled to about one-half of its height, a partition 5 is introduced therein, said partition being of a circular form with an external diameter substantially equal to the internal diameter of the ferrule 1. The periphery of the partition 5 is equipped with a gold-nickel wire assuring its subsequent brazing to the ferrule 1 with satisfactory tightness. Thereafter, the remaining portion of the powder mixture is poured in so as to completely fill the cavity of the mold. The assembly is placed in a furnace under vacuum (pressure less than $10^{-3}$ Pa then heated to 1125° C. for 15 minutes approximately. After cooling, parts 2 and 3 are removed by means of turning while leaving—as shown in FIG. 2, the support 1 clad by the abradable material 6, including the partition 5. In a variant of embodiment, the parts 2 and 3 may be present in the form of removable tooling lined with an antiwetting agent, such as alumina.

I claim:

1. Process for the manufacture of shaped pieces comprising a first part of a porous material subject to wear by abrasion and a second support part of a solid material, comprising the steps of: providing a mold, at least one part of which constitutes a support part, coating the internal surface of the other parts with an antiwetting agent, effecting synthesis of the porous material and its bonding to the support part by filling said mold with a homogeneous mixture of two powders, one of which, representing 80 to 99.5% by weight of the mixture, is a base material selected from the group consisting of nickel, cobalt, iron and different alloys of these metals, and the other, representing 0.5% to 20% by weight of the mixture, is a fusible material capable of diffusion and chosen from the group consisting of tin, indium, gallium, germanium, antimony, together with mixtures and alloys of said metals and by heating said mold in a controlled atmosphere, at a temperature higher then 900° C. but in all cases lower than the solidus of the base material and the material of the mold, for a sufficient period of time to permit the migration of the fusible material and the bonding, by means of diffusion brazing, of the grains of the powder to each other and to the support part.

2. Process according to claim 1, wherein the final shape of the piece is obtained by removing the parts of the mold walls not bonded to the said porous material.

3. Process according to one of claims 1 or 2 wherein, during the filling of the mold with the mixture of the two powders, at least one partition is inserted into said powders, which is bonded to the porous material during the synthesis of the latter.

* * * * *